United States Patent [19]

Kelly

[11] Patent Number: 4,647,122

[45] Date of Patent: Mar. 3, 1987

[54] FILTER CONNECTOR

[75] Inventor: Joseph F. Kelly, Phoenix, Ariz.

[73] Assignee: ITT Corporation, New York, N.Y.

[21] Appl. No.: 766,322

[22] Filed: Aug. 16, 1985

[51] Int. Cl.[4] ..... H01R 13/66

[52] U.S. Cl. ..... 339/14 R; 29/845; 29/854; 339/143 R; 339/147 R

[58] Field of Search ..... 333/182, 183; 339/14 R, 339/14 P, 143 R, 147 R, 147 P, 136 R, 136 M, 138; 29/845, 854

[56] References Cited

U.S. PATENT DOCUMENTS

| | | | |
|---|---|---|---|
| 3,329,911 | 7/1967 | Schlicke et al. | 333/182 |
| 3,535,676 | 2/1968 | Schultz, Sr. | 339/143 |
| 3,702,422 | 11/1972 | Scitor | 333/182 |
| 4,212,510 | 7/1980 | Ritchie et al. | 333/183 |
| 4,371,226 | 2/1983 | Brancaleone | 339/147 R |
| 4,376,922 | 3/1983 | Muzslay | 339/147 R |
| 4,519,665 | 5/1985 | Althouse et al. | 339/143 R |

FOREIGN PATENT DOCUMENTS

| | | | |
|---|---|---|---|
| 2059182 | 4/1981 | United Kingdom | 339/147 P |

*Primary Examiner*—John McQuade

*Attorney, Agent, or Firm*—T. L. Peterson; R. G. Wick

[57] ABSTRACT

A filter connector is provided which securely holds each of its contacts and electrically connects a capacitor between each contact and an electrical ground, which is rugged and can be constructed at low cost. The connector includes a metal shell with a rear shell wall having holes through which the contacts pass. A group of tubular capacitors with terminals at its outside and inside are installed in the holes, and each contact passes through a central hole of a tubular capacitor. The outside terminal of each capacitor is soldered to the rear shell wall, and the inner terminal of each capacitor is soldered to a contact. The capacitor has a flange on its front end that abuts the front face of the rear shell wall, and the contact has an enlarged middle portion whose rear abuts the front of the capacitor and whose front abuts a front insulator of the connector.

6 Claims, 4 Drawing Figures

FILTER CONNECTOR

BACKGROUND OF THE INVENTION

Filter connectors are broadly used to control electromagnetic interference by the use of capacitive and inductive elements for coupling each of several contacts to ground. D-subminiature connectors which employ only capacitive coupling to ground are manufactured and sold in large quantities. In both the commercial and industrial markets for D-subminiature connectors, the marketplaces are extremely cost-conscious. One type of filter D-subminiature connector has included tubular capacitors grounded by a separate ground plane component which is installed in the connector shell and which is coupled to the capacitor by spring fingers or soldering. Insulators both forward and rearward of the ground plane component were used to mechanically support the contacts. The use of a separate ground component for electrical connection and two insulators for support resulted in appreciable cost. A rugged filter connector which could be constructed at very low cost, would have significant advantages in the marketplace.

SUMMARY OF THE INVENTION

In accordance with one embodiment of the present invention, a filter connector is provided which is of simple and rugged design. The connector includes a metal shell with a perforated rear wall through which contacts pass, and a group of mounts which support each contact on the shell. At least one of the mounts comprises a tubular capacitor with an outer terminal conductively bonded to the shell and an inner terminal conductively bonded to the contact.

An insulator lies in the shell forward of the rear shell wall, and has a group of holes through which the conductors pass. Each conductor can have an enlarged middle portion with a rear end that abuts the front of a corresponding mount and a front end that abuts the insulator. By physically and electrically coupling the rear of a contact to a tubular capacitor which is, in turn, physically and electrically directly connected, as by soldering, to the shell of the connector, intermediate grounding elements are avoided and a rugged connector is provided.

The novel features of the invention are set forth with particularity in the appended claims. The invention will be best understood from the following description when read in conjunction with the accompanying drawings.

DESCRIPTION OF THE PREFERRED EMBODIMENT

Figure 2:
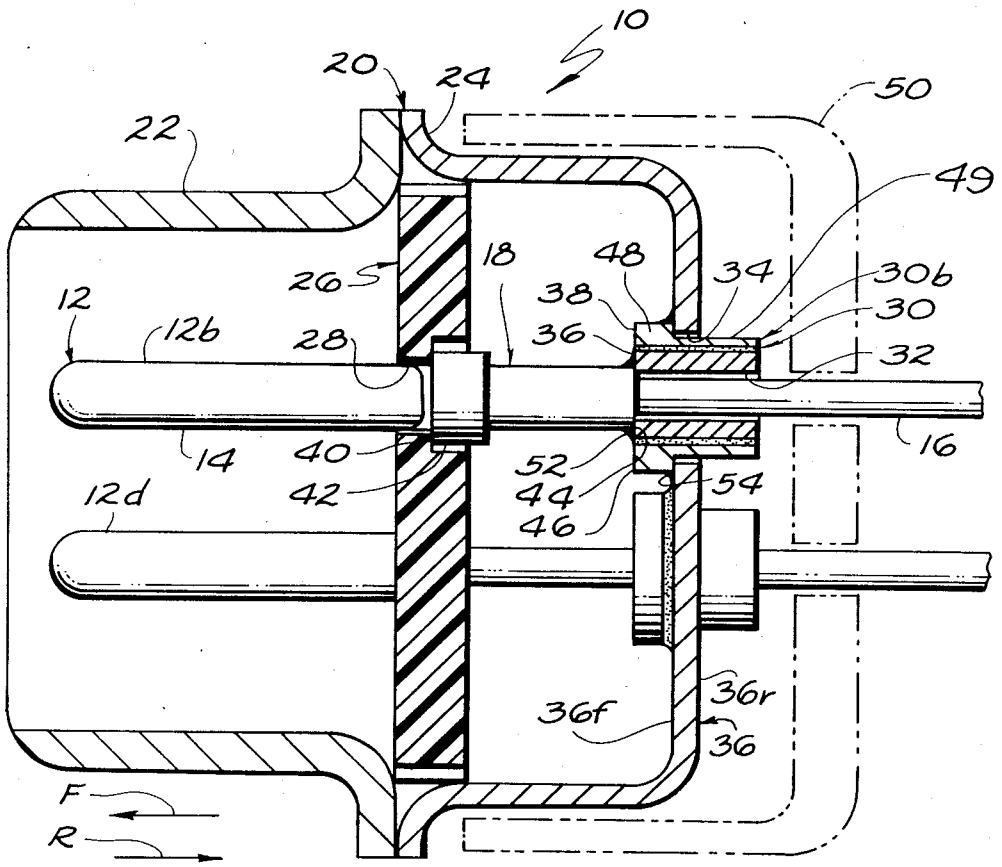
FIG. 2 is a view taken on the line 2—2 of FIG. 1.

FIG. 2 illustrates a D-subminiature connector 10 which has seven contacts 12. Each contact has a front mating portion 14 for mating with a contact of another connector, a rearward portion 16 for coupling to other conductors, and a middle portion 18. The connector includes a shell 20 with a front shell part 22 which surrounds the front portions of the contacts, and a rear shell part 24 through which the contacts pass. The shell, and especially the rear part shell 24, is electrically grounded.

A front insulator 26 serves as a front mounting means which supports the front portion of each contact. The insulator has numerous holes 28 through which the contacts pass. The rear of the front mating portion 14 of each contact rests on the walls of the hole. A more rearward portion of each contact is supported on a mount 30. The mount 30 has a central hole 32 through which the rearward portion 16 of a contact passes. Each mount is received in one of seven holes 34 of the rear wall 36 of the shell.

Most of the mounts 30 are tubular capacitors with inner and outer terminals 36, 38 located respectively near the radially inner and radially outer portions of the capacitor. A predetermined capacitance is established between these terminals, to dissipate high frequency noise on a contact.

Figure 1:
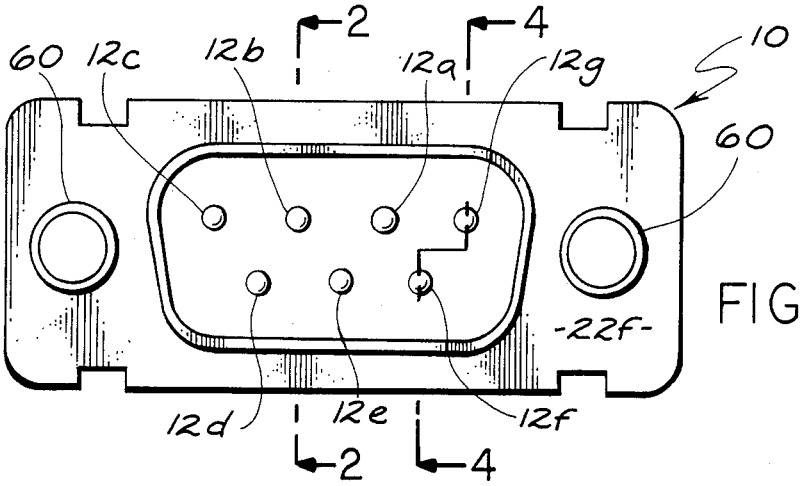
FIG. 1 is a front elevation view of a connector constructed in accordance with the present invention.
Figure 3:
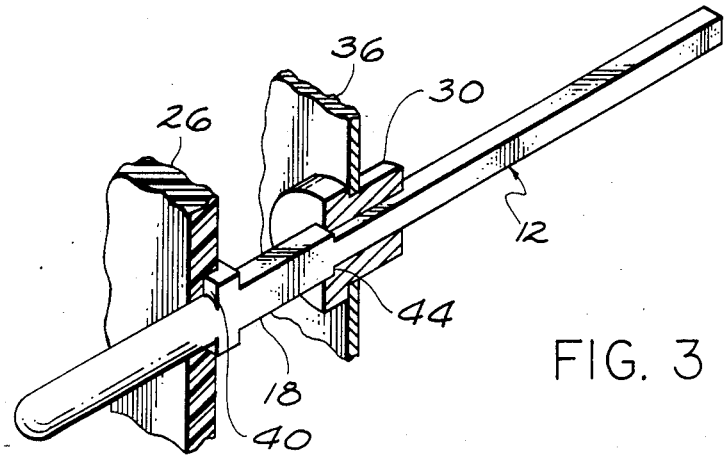
FIG. 3 is a partial sectional perspective view of the connector of FIG. 2.

While a unitary front insulator 26 is provided to support a forward portion of each contact, the provision of numerous individual mounts 30 enables each contact to be individually electrically coupled or insulated from ground. In this particular connector 10 (FIG. 1), five of the contacts 12*a*–12*e* are capacitively coupled to ground through a mount that is a tubular capacitor. One of the contacts 12*f* is directly connected through its corresponding mount to the rear wall of the shell. The other contact 12*g* is isolated from ground to provide a maximum impedance between the contact 12*g* and ground. All of the mounts have substantially the same external configuration, although only the five tubular capacitor mounts include tubular capacitors.

The middle portion 18 (FIG. 2) of each contact is enlarged, at least at its opposite ends, to respectively abut the front insulator 26 and a corresponding mount 30. The front of the middle portion forms a forwardly-facing shoulder 40 which abuts a corresponding rearwardly-facing surface 42 on the insulator, to limit forward movement, in the direction of arrow F, of the contact with respect to the insulator and therefore with respect to the shell within which the insulator is mounted. The rear of the contact middle portion forms a rearwardly-facing shoulder 44 which abuts a forwardly-facing surface 46 on the front of the mount. This limits rearward movement of the contact. The mount has a flange 48 that abuts a forwardly-facing surface 36*f* of the rear shell wall to prevent rearward movement of the mount, and a reduced diameter portion 49 that extends through the shell hole. As a result of the abutments of the opposite ends of the contact middle portion, the contact is securely held in position against forward and rearward movement. The forward and rearward portions of the contacts are respectively held in holes 28, 32 of the insulator and mount, to limit radial movement of the contacts. In this way, each contact is securely held in position. A plastic cover indicated at 50, clips around the rear shell part.

The connector 10 can be constructed in a rugged manner and at low cost. The rear shell part 24 can be easily deformed and perforated, and the front shell part and front insulator can all be formed at low cost by well-known methods. Each contact 12 can be formed as from a wire rod by well-known methods. The connector can be assembled by first dropping each of the mounts 30 into their corresponding holes 34, with the rearward surface 36*r* of the rear wall facing down. The contacts 12 can then be installed by projecting their rearward portions 16 through the holes in the mounts. The assembly can then be lowered into a dip solder bath to form solder conductive bondings at 52 and 54 which mechanically and electrically bond each mount respectively to the rear wall of the shell and to the contact which passes through the mount.

The front insulator can be slipped over the front portions 14 of the contacts, and the front shell part 22 can be placed on the rear shell part 24. Then projecting portions 60 (FIG. 1) on the rear shell part which project through corresponding holes of the front shell part, can be deformed to lie against the front face 22*f* of the front shell part. This secures the front and rear shell parts together, and secures the insulator between them.

Figure 4:
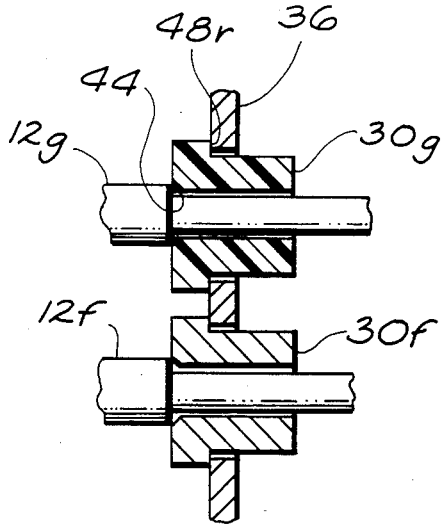
FIG. 4 is a view taken on the line 4—4 of FIG. 1.

FIG. 4 illustrates the grounding and insulating mounts 30*f*, 30*g*, which couple their respective contacts to the shell rear wall 36. The grounding mount 30*f* is constructed of solderable metal such as copper, and can be used to ground the rear shell part. The insulating mount or feed-through 30*g* is constructed of an insulating material, and is held in position by abutment with the contact shoulder 44, and by abutment of the rear surface 48*r* of the mount flange with the rear shell wall 36.

Thus, the connector provides capacitive coupling for at least one contact, and yet the connector is of rugged design and can be made at very low cost. The use of tubular capacitors not only to capacitively couple a contact to ground, but to directly support a rearward portion of the contact to the shell and to limit rearward movement of a contact with respect to the shell, minimizes the number of parts to lower the cost and increase the ruggedness of the connector.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In a filter connector which includes a plurality of contacts, wherein at least one contact must be capacitively coupled to ground, and which also includes a grounding metal shell which surrounds said plurality of contacts, the improvement wherein:

said shell includes a rear wall which has a plurality of holes through which said contacts pass; and including a plurality of mounts which each support one of said contacts to said shell, at least one of said mounts comprising a tubular capacitor which has a central hole and which has inner and outer terminals respectively at the radially inside and outside portions of the tubular capacitor;

said tubular capacitor lying in a first of said shell holes and with the outer capacitor terminal conductively bonded to said shell, and a first of said contacts extends through the central hole in the capacitor with the inner capacitor terminal conductively bonded to the contact;

said shell includes front and rear shell parts, said plurality of contact-passing holes being formed in said rear shell part, said rear shell part having a forward face;

a front insulator mounted in said shell forward of said mounts, said front insulator having a plurality of holes aligned with said holes in said rear shell part, said insulator having a rear face which faces said forward face of said rear shell part;

each of said mounts has a forward flange on the outside which abuts the forward face of said rear shell part and a reduced diameter portion which extends through a hole in the rear shell part;

each of said contacts has a front mating portion extending forward of said front insulator, a middle contact portion with front and rear ends of greater width than said holes in said front insulator and mount respectively, and a rearward portion of smaller width than said central hole in said mounts;

each contact positioned with its front portion extending through a hole in the insulator, its rear portion extending through the hole in a mount, and its middle contact portion lying between the forward face of said rear shell part and the rear face of said insulator.

2. The improvement described in claim 1 wherein:

at least one other of said mounts is formed primarily of electrically conductive material and has inner and outer terminals at its inside and outside that are directly electrically bonded respectively to a conductor and to said rear shell part.

3. The improvement described in claim 1, wherein:

at least one other of said mounts is formed primarily of electrically nonconductive material, and has a flange lying against the front face of said rear wall and has a portion that extends rearwardly through a hole in the shell rear wall, and one of said contacts has an enlarged middle portion that lies forward of said mount of nonconductive material and abuts said mount.

4. A filter connector comprising:

a shell with at least a rear wall of electrically conductive material, said rear wall having a plurality of holes;

an insulator lying in said shell forward of said rear wall, said insulator having a plurality of holes aligned with the holes in said rear wall;

a plurality of largely tubular capacitors with central holes and having inner and outer terminals, each capacitor having a first portion extending through a hole in said rear wall, and each capacitor having a flange at its front which lies immediately forward of said rear wall and which abuts said rear wall;

a plurality of contacts, each passing through the center of a tubular capacitor and through a hole in said insulator, each contact having a middle portion which has a front end that has a greater width than a corresponding insulator hole and which substantially abuts the insulator, and each contact middle portion having a rear end that has a greater width than the corresponding mount central hole and which substantially abuts the mount;

the inner terminal of each mount being soldered to the conductor which passes therethrough, and the outer terminal of each mount being soldered to the rear wall of the shell.

5. The connector described in claim 4 including:

a back cover of insulative material that surrounds at least said rear wall of said shell and which is attached to said shell.

6. A method for forming a connector with at least some contacts capacitively connected to ground, comprising:

forming a conductive shell with a rear wall that has multiple holes and has a forward face;

forming a plurality of mounts, each of which has a forward flange and a reduced diameter exterior adapted to closely fit within the holes of said shell and which has an interior that includes a tubular capacitor which has a central hole and which has inner and outer terminals respectively at the inside and outside portions of the tubular capacitor;

installing each of said mounts with the reduced diameter portion extending through one of the holes in the rear wall and with the forward flange abutting the forward face of the rear wall of said shell;

forming a plurality of elongated conductors, each of which has front and rear mating portions, and a middle portion with front and rear ends, said rear end having a greater width than said central hole of said tubular capacitor;

projecting the rear portions of each of the plurality of elongated conductors through the holes in said tubular capacitors, so the middle and front portions of each conductor extends forwardly of the capacitor;

projecting the front ends of the conductors through holes of a front insulator until the front end of the middle portion of each conductor abuts the insulator, with the holes in the insulator being of a smaller width than said front end of said middle portion of each conductor, whereby forward and rearward movement of said conductor is limited, and installing the insulator in the shell;

heating said rear wall and conductors and flowing solder against locations on said tubular capacitor that respectively lie adjacent to said rear wall and adjacent to said conductor.

* * * * *